United States Patent [19]

Workman, Jr.

[11] Patent Number: 4,492,146

[45] Date of Patent: Jan. 8, 1985

[54] SHUT-OFF DEVICE FOR A FLUID DRIVEN MOTOR

[75] Inventor: William Workman, Jr., Spring Lake, Mich.

[73] Assignee: Cooper Industries, Inc., Houston, Tex.

[21] Appl. No.: 401,906

[22] Filed: Jul. 26, 1982

[51] Int. Cl.[3] ..... F15B 13/04

[52] U.S. Cl. ..... 91/29; 91/31; 91/59; 173/12

[58] Field of Search ..... 91/59, 29, 31, 28; 173/12; 81/470; 137/613, 462

[56] References Cited

U.S. PATENT DOCUMENTS

| | | | |
|---|---|---|---|
| 3,534,769 | 10/1970 | Leveque | 91/29 |
| 3,608,647 | 9/1971 | Borries | 91/59 |
| 3,791,459 | 2/1974 | Workman, Jr. | 91/59 |
| 3,924,693 | 12/1975 | Whitehouse | 91/59 |
| 4,024,892 | 5/1977 | Prisco et al. | 91/31 |
| 4,075,928 | 2/1978 | Bitonti | 91/29 |
| 4,223,745 | 9/1980 | Workman, Jr. | 91/59 |
| 4,320,806 | 3/1982 | Koltermann et al. | 91/59 |

*Primary Examiner*—Sheldon J. Richter
*Assistant Examiner*—Randolph A. Smith
*Attorney, Agent, or Firm*—Richard S. MacMillan; David D. Murray

[57] ABSTRACT

The present invention relates to a device for shutting off a supply of pressurized motive fluid to an associated fluid driven motor in response to a predetermined motor back pressure indicating a predetermined load on the motor. The device comprises a housing having a fluid inlet connected to a supply of motive fluid and a fluid outlet connected to supply pressurized fluid to the associated fluid driven motor. A passageway extends through the housing between the fluid inlet and the fluid outlet. A shut-off piston is slidably mounted with the housing and is shiftable to close the housing passageway and shut off the supply of pressurized fluid to the motor in response to a predetermined motor back pressure. An orifice of variable size is provided in the housing passageway and is utilized to reduce the pressure of the fluid supplied to the motor. The size of the orifice is controlled by a pilot piston slidably mounted within the housing and shiftable between a first and second position to vary the size of the orifice from a restricted to an open size. The pilot piston is shiftable in response to a predetermined motor back pressure to enlarge the orifice prior to the closing of the shut-off piston. Enlarging the orifice at this time results in an increase in pressure to the motor just prior to shut off. It has been found that this increase in final pressure to the motors permits the final shut-off torque of the motor to be more accurately controlled, regardless of the type of load encountered by the motor.

9 Claims, 2 Drawing Figures

SHUT-OFF DEVICE FOR A FLUID DRIVEN MOTOR

BACKGROUND OF THE INVENTION

This invention relates generally to a pressure responsive shut-off device and, in particular, to a shut-off device utilized in the control of fluid operated motors.

Fluid operated tools, such as pneumatic nut setters, are in common use in assembly operations. A typical fluid powered nut setter is hand held by an operator, and is used to perform multiple operations such as setting a nut or other fastener precisely to a desired torque. In order to prevent reaction torque from being transferred to the operator as the nut is set and the motor stalls, such tools are typically provided with a shut-off valve intended to shut off the supply of motive fluid to the tool when the desired torque is reached. In such tools, it is well known that the torque produced by the motor is proportional to the motor back pressure. Therefore, such shut-off valves are commonly responsive to a predetermined motor back pressure to shut off motive fluid to the motor when the desired final torque is achieved.

One problem associated with shut-off valves used with fluid operated tools in which torque control is important relates to the wide variety of operations which can be encountered. For example, a pneumatic nut setting tool can be used for several types of fastening operations, including the fastening of joints referred to as "hard make" and "soft make". In a hard make, the nut or other fastener being rotated offers little resistance to the applied torque until it is finally set against a hard surface, at which time the resistance suddenly increases. Motor torque, therefore, is fairly constant throughout most of the cycle, then rises very steeply as the motor approaches or reaches a stall condition. In order to properly set the fastener, the valve must respond very rapidly to shut off the motive fluid.

As an example of a soft make, members being fastened may be pushed together by the nut as it is being tightened onto a threaded bolt. The motor torque will therefore increase more gradually, over a greater period of time, as the motor approaches a stall condition. In prior art shut-off devices, because of the different torque/time relationships encountered, the final torque actually realized at shut off varies widely between hard and soft makes.

An example of a fluid pressure responsive shut-off valve is disclosed in U.S. Pat. No. 3,373,824 to H. L. Whitehouse. In the Whitehouse device, a restrictive orifice is provided in the motive fluid flow path near the motor inlet. The orifice reduces fluid pressure at the motor inlet during free running of the motor. As the motor is loaded and approaches stall, the motor back pressure increases. A valve which is biased open by a spring is operable to interrupt the supply of motive fluid to the motor when the motor back pressure increases sufficiently to overcome the spring bias force and to close the valve.

U.S. Pat. No. 3,493,056 to J. H. Boeger et al. discloses a valve mechanism for shutting off the supply of motive fluid to a fluid motor which is compensated for variations in fluid supply pressure. The Boeger et al. valve includes a pilot valve element which shifts in response to an increase in motor back pressure above a predetermined proportion of the fluid supply pressure. A shut off valve responsive to the pilot valve then closes to shut off the supply of motive fluid to the motor.

U.S. Pat. No. 3,786,873 to Whitehouse discloses a stall torque regulator valve having a restricted orifice which is gradually closed by a sliding valve in response to an increase in motor torque. The orifice is so shaped that its effective size is reduced in a predetermined desired relationship to increasing torque as the orifice is closed by the valve sliding across the orifice.

Other illustrative pressure responsive fluid controlling devices are disclosed in U.S. Pat. Nos. 3,608,647 to Borries, 3,667,345 to Schaedler et al. and 3,696,834 to VonHoff, Jr.

In prior art shut-off valves of the character described above, mass and thus inertia of the valve components delay response of the valve to back pressure changes and thus delay valve component motion and closure of the valve. During this short interval, motor torque will continue to increase. This increase is generally small with soft make fasteners but can be substantial with hard make fasteners. The actual torque delivered when the valve is finally shut therefore is a function of the torque/time relationship of the associated assembly operation. This relationship between joint or fastener "make" and torque application, in practice, becomes simply torque application variability and cannot be tolerated.

SUMMARY OF THE INVENTION

The present invention relates to a shut-off device which is designed to reduce the undesirable variation in shut-off torque encountered by prior art devices in hard and soft make operations. Basically, the device of the present invention is provided with a variable orifice in the flow path to an associated motor. The variable orifice enlarges just prior to motor stall such that the fluid pressure to the motor is increased to increase the torque finally delivered at stall and shut-off. It has been found that this increase of final pressure to the motor substantially reduces the variation in shut-off torque between hard and soft make operations.

The shut-off device comprises a housing having a fluid inlet connected to a supply of motive fluid and a fluid outlet connected to supply pressurized fluid to the associated fluid driven motor. A passageway extends through the housing between the fluid inlet and the fluid outlet.

An orifice of variable size is provided in the passageway and is utilized to reduce the pressure of the fluid supplied to the motor during normal free-running operation. The size of the orifice is controlled by translation of a pilot piston mounted within the housing and moveable between a first and second position to vary the size of the orifice from a restricted to an open size, respectively. A shut-off piston is also slidably mounted within the passageway and is shiftable to close the passageway and shut off the supply of pressurized fluid to the motor in response to an increase in motor back pressure. The pilot piston translates in response to a motor back pressure to enlarge the orifice prior to the closing of the shut-off piston. Enlarging the orifice at this time results in an increase in pressure to the motor just prior to shut off.

In a free running condition, the variable orifice is of a restricted size to create a pressure drop across the orifice to reduce the motor speed and inertia. As the motor approaches a stall condition, the motor torque increases along with the associated motor back pressure. The pilot piston begins to move from the first to the second position to enlarge the variable orifice and provide an increased air flow to the motor, thereby increasing the motor torque. Means are provided for delaying the shifting of the shut-off piston to allow the motor to approach a stall condition. By providing an increased air flow to the motor just prior to shut off, the shut-off torque finally realized is more precisely controlled, and is less affected by whether the assembly operation in a hard or a soft make.

DESCRIPTION OF THE PREFERRED EMBODIMENT

Figure 1:
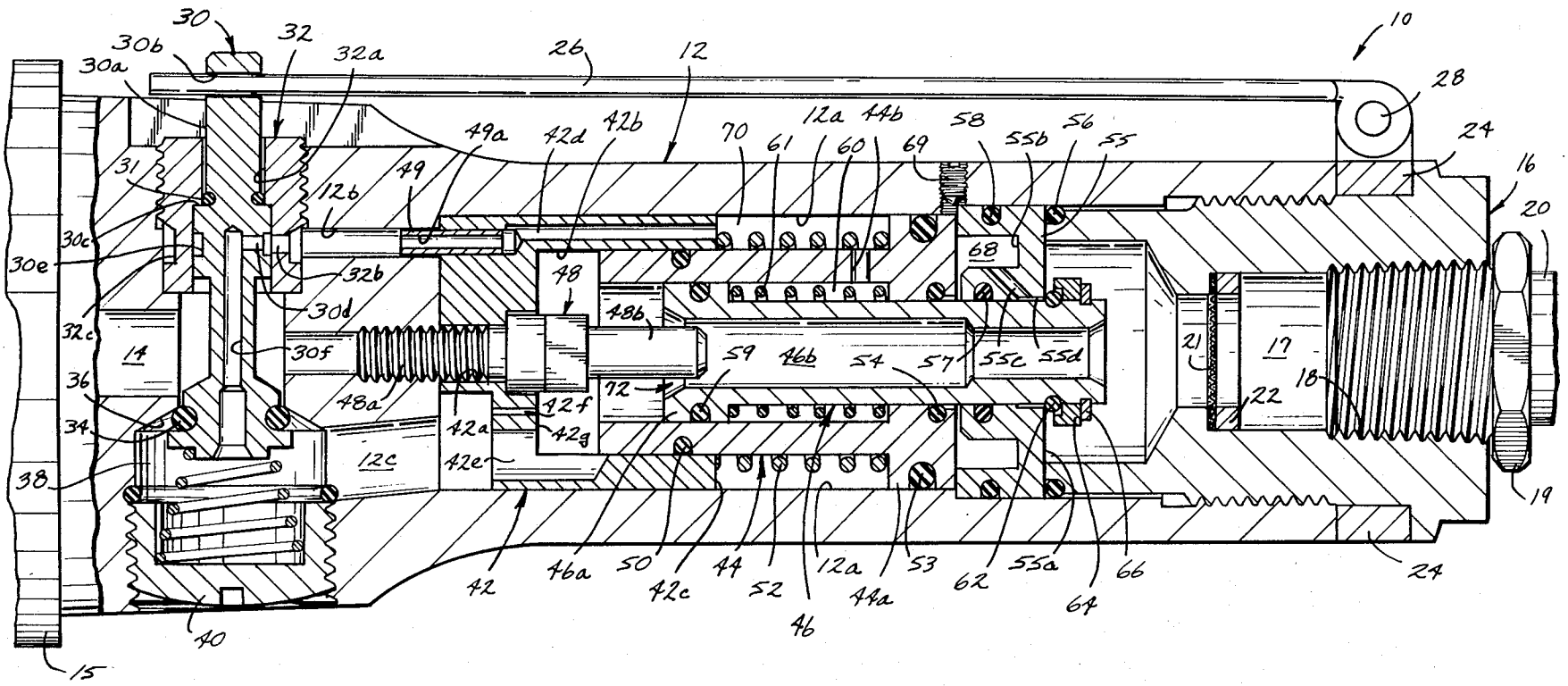
FIG. 1 is a sectional view of an air shut-off valve according to the present invention in the non-actuated position.

Referring to the drawings, there is shown an air shut-off control device 10 according to the present invention. The device 10 includes a generally cylindrical outer housing 12 having a centrally located passageway 14 formed at one end thereof for supplying pressurized air to a pneumatic motor 15. While not shown in the drawings, the one end of the housing 12 is typically provided with suitable means for attachment to the pneumatic motor 15. The opposite end of the housing 12 is adapted to threadably receive an end cap 16 having a central passageway 17 and an internally threaded end portion 18. An end fitting 19 of a pressurized air supply line 20 is threaded into the end portion 18. The supply line 20 is connected to a remote pressurized air source (not shown). A filter screen 21 is mounted within the passageway 17 by means of a securing ring 22.

It should be noted that throughout the following description, several components of the control valve 10 will be described with reference to the "upstream" and "downstream" end of the device 10. In both FIGS. 1 and 2, the "upstream" side of the device 10 is the right hand side, while the "downstream" side of the valve is the left hand side.

An annular mounting ring 24 is coaxially positioned between the extreme one end of the housing 12 and the end cap 16 and is utilized for pivotally mounting an actuating arm 26 at pivot point 28. The actuating arm 26 extends longitudinally along the exterior of the housing 12 and has an outer end which is coupled to operate a start valve 30.

The start valve 30 is mounted for slidable movement within a cylindrical member 32 which is threaded into the sidewall of the housing 12. The start valve 30 has an upper stem **30*a* provided with an aperture 30*b* for receiving the outer end of the actuating arm 26. The upper stem 30*a* extends downwardly and terminates at an upwardly facing shoulder portion 30*c*. The lower end of the upper stem 30*a* is provided with an outer annular groove for receiving an O-ring 31 which sealingly engages an inner cylindrical wall 32*a* of the cylindrical member 32 when the start valve 30 is in the non-actuated position shown in FIG. 1. The lower end of the start valve 30 extends downwardly into the main body housing 12 and has an O-ring 34 mounted thereon which is adapted to seat against a downwardly facing inclined sealing surface 36**.

When the start valve 30 is seated, as shown in FIG. 1, pressurized air in the chamber 38, which is located immediately below the start valve 30, exerts a sufficient upward force on the valve 30 to urge the O-ring 34 against the sealing surface 36 and prevent pressurized air from being supplied to the passageway 14. A plug 40 is located directly below the start valve 30 and is threaded into the sidewall of the outer housing 12. The opening which is closed by the plug 40 facilitates the assembly of the start valve 30 into the housing 12.

The interior of the housing 12 is adapted to receive a cylindrical insert member 42, a shut-off piston 44, and a pilot piston 46. The cylindrical member 42 is securely mounted within the housing 12 by means of an orifice pin 48 having a threaded portion **48*a* on one end thereof which extends through an aperture 42*a* formed in the end wall of the cylindrical member 42 and into a suitably threaded aperture in the housing 12. A hollow positioning pin 49 is utilized to properly locate the cylindrical member 42 relative to the housing 12 before the pin 48** is tightened.

The cylindrical member 42 has an inner cylindrical chamber **42*b* for receiving the downstream end of the shut-off piston 44. The downstream end of the shut-off piston 44 has an outer annular groove formed therein for receiving an O-ring 50 which sealingly engages the inner wall of the cylindrical chamber 42*b*. A helical compression spring 52 is coaxially positioned about the piston 44 and has one end which engages an end surface 42*c* of the cylindrical member 42 and has an opposite end which engages an enlarged end portion 44*a* formed on the upstream side of the shut-off piston 44. The spring 52 urges the piston 44 in an upstream direction. The enlarged end 44*a* of the piston 44 has an outer annular groove formed therein for receiving an O-ring 53 which sealingly engages an inner cylindrical wall 12*a* of the housing 12. Also, the enlarged end 44*a* has an inner annular groove formed therein for receiving an O-ring 54 which sealingly engages the outer cylindrical surface of the pilot piston 46**.

The axial movement of the piston 44 is limited in an upstream direction by a stop ring 55 which is secured within the housing 12 by the end cap 16. An O-ring 56 is positioned about the downstream end of the end cap 16 to sealingly engage the inner wall of the housing 12. The stop ring 55 is provided with an inner annular groove for receiving an O-ring 57 which sealingly engages the outer cylindrical surface of the pilot piston 46. The stop ring 55 is also provided with an outer annular groove for receiving an O-ring 58 which sealingly engages the inner wall of the housing 12.

The pilot piston 46 is coaxially positioned for axial movement within the shut-off piston 44. The pilot piston 46 has an enlarged downstream end **46*a* which is provided with an outer annular groove for receiving an O-ring 59 which sealingly engages the inner cylindrical wall of the shut-off piston 44. The inner wall of the shut-off piston 44 and the outer wall of the pilot piston 46 cooperate to form an annular chamber 60 for receiving a helical compression spring 61 which urges the pilot piston 46 in a downstream direction and the shut-off piston 44 in an upstream direction. The downstream movement of the pilot piston 46 is limited by an O-ring 62 which is received within an outer annular groove formed on the upstream side of the pilot piston. The O-ring 62 sealingly engages an end surface 55*a* of the stop ring 55. An outer annular ring stop 64 and an associated snap ring 66 maintain the O-ring 62** within the outer groove.

Figure 2:
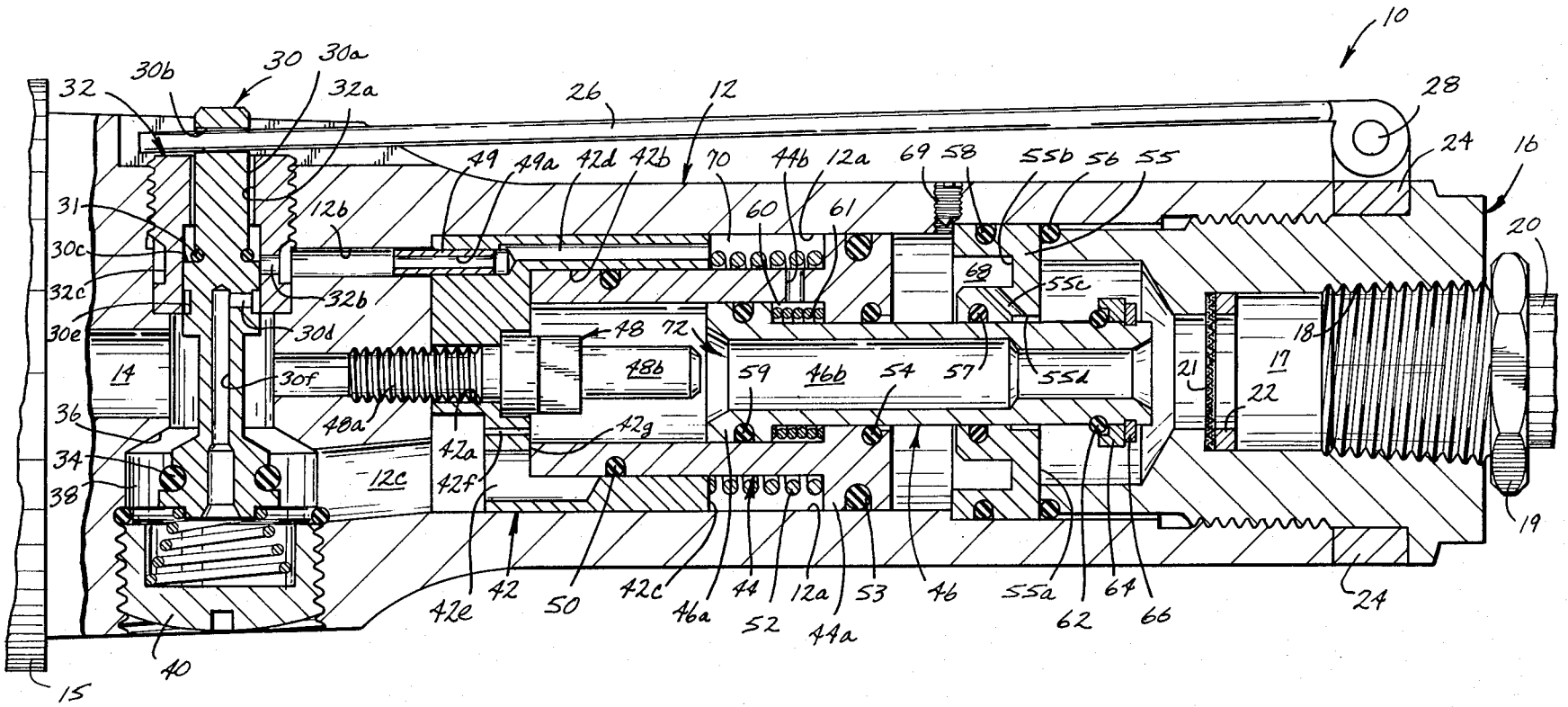
FIG. 2 is a sectional view, similar to FIG. 1, but showing the relative position of the components of the valve after shut-off but before the start valve has been released.

The stop ring 55 is provided with an annular cutout 55*b* which cooperates with the end wall of the shut-off piston 44 to define an annular chamber 68. A bleed valve 69 is threaded into the sidewall of the housing 12 and is in fluid communication with the chamber 68 when the upstream end of the shut-off piston is disengaged from the stop ring, as shown in FIG. 2. A passageway 55*c* formed in the stop ring 55 provides fluid communication between the chamber 68 and an annular cavity 55*d* formed adjacent the end surface 55*a* of the stop ring 54. When the pilot piston 46 is moved in an upstream direction to unseat the O-ring 62 from the sealing surface 55*a*, as shown in FIG. 2, the chamber 68 receives pressurized air through the passageway 55*c* from the pressurized passageway 17.

The outer cylindrical wall of the shut-off piston 44 and the inner housing wall 12*a* cooperate to define an annular chamber 70 which communicates with the chamber 60 by a passageway 44*b* formed in the sidewall of the shut-off piston 44. The chambers 70 and 60 are in fluid communication with the pressurized chamber 38 through a series of passageways provided in the cylindrical member 42, the housing 12, the cylindrical member 32, and the start valve 30. These passageways include an axially extending passageway 42*d* formed in the cylindrical member 42, a passageway 49*a* formed in the positioning pin 49, a passageway 12*b* formed in the housing 12, a radial passageway 32*b* and a cooperating outer annular groove 32*c* formed in the cylindrical plug 32, a radial passageway 30*d* and a cooperating annular groove 30*e* formed in the start valve 30, and a centrally located passageway 30*f* formed in the start valve 30 and extending downwardly from the radial passageway 30*d* to the extreme lower end of the valve 30.

The pilot piston 46 is provided with an axially extending, central passageway 46*b* which communicates with the inlet passageway 17 of the end cap 16 to supply pressurized air through an opening 42*e* in the cylindrical member 42 and a passageway 12*c* in the housing 12 and into the chamber 38. As shown in FIG. 1, the orifice pin 48 has a reduced diameter end portion 48*b* which extends axially in an upstream direction into the passageway 46*b* of the pilot piston 46 to define an orifice. The orifice pin 48 thus provides a restriction in the air flow passageway 46*b* to reduce the pressure of the air supplied to the motor 15 relative to the supply pressure in the passageway 17. As will be discussed below, the axial position of the pilot piston is controlled to vary the size of the orifice 72.

The cylindrical member 42 is provided with a relatively small passageway 42*f* such that, when the shut-off piston is in its furthest downstream position, as shown in FIG. 2, a small amount of pressurized air is supplied to the chambers 38, 70 and 60.

The operation of the device 10 will now be described. FIG. 1 illustrates the components of the control device 10 in the non-actuated position. In this position, pressurized air in the passageway 17 is supplied through the central passageway of the pilot piston 46*b* to the chamber 38 below the start valve 30. The pressurized air in the chamber 38 exerts an upward force on the valve 30 to maintain the O-ring 34 in sealing engagement with the sealing surface 36 and prevent pressurized air from being supplied to the motor 15 by the passageway 14. As previously mentioned, the pressurized air in the chamber 38 is also supplied through a series of passageways to the chambers 70 and 60. Also, the O-ring 62 sealingly engages the end surface 55*a* of the stop ring 55 to prevent pressurized air from entering the chamber 68.

When the start valve 30 is in the seated position as shown in FIG. 1, the chambers 38, 70, and 60 are in fluid communication with one another. However, when the start valve 30 is depressed to an operating position as shown in FIG. 2, the upwardly facing shoulder portion 30*c* of the start valve 30 is moved below the radial passageway 32*b* and the O-ring 31 is disengaged from the inner cylindrical wall 32*a* such that the chambers 70 and 60 are vented to the atmosphere through the annular opening defined by the upper stem 30*a* of the start valve 30 and the inner cylindrical wall 32*a* of the cylindrical member 32.

When the start valve 30 is depressed, the pressurized air in the chamber 38 is supplied to the motor 15 through the passageway 14. The actual pressure supplied to the motor is reduced from the pressure in the passageways 17 and 46*b* as a result of the restriction in the passageway 46*b* caused by the intrusion of the orifice pin 48*b*. The reduced pressure to the motor 15 functions to reduce the motor speed and inertia. Also, as previously mentioned, the chambers 60 and 70 are vented past the upper stem 30*a* of the valve 30 to the atmosphere.

As the motor approaches a stall, air pressure at the inlet of the motor and thus in the passageway 14 and the chamber 38 increases. When the motor back pressure has increased to a point sufficient to overcome the downstream force exerted on the pilot piston 46 by the spring 61, the pilot piston 46 will begin to move in an upstream direction. As the pilot piston begins to move, the O-ring 62 is lifted off the sealing surface 55*a* and the pressurized air in the passageway 17 is permitted to enter the chamber 68 through the passageway 55*c*. The passageway 55*c* is sufficiently small to delay pressurizing of the cavity 68 long enough to allow the motor to approach the stall condition. As the pilot piston 46 moves further in an upstream direction away from the orifice pin 48, the pressure differential across the orifice pin is reduced such that more air is permitted to enter the motor, giving a final pressure increase just prior to stall.

When the pressure in the chamber 68 increases sufficiently to overcome the upstream force exerted on the shut-off piston 44 by the spring 52, the shut-off piston 44 will begin to move in a downstream direction. When the piston 44 has moved such that the downstream end of the piston seats against the surface 42*g* of the cylindrical member 42, pressurized air to the motor 15 through the passageway 42*e* is blocked. At this time, the components of the device 10 will have the relative positions as shown in FIG. 2.

When the start valve 30 is released, a small amount of pressurized air flowing through the passageway 42*f* pressurizes the chambers 38, 70 and 60. With the chambers 70 and 60 pressurized, and with the forces exerted by the springs 52 and 61, the shut-off piston 44 and the pilot piston 46 return to their non-actuated position, as shown in FIG. 1. Air trapped in the chamber 68 is released through the adjustable vent 69. The adjustable vent 69 can also be utilized to control the time required to pressurize the cavity 68.

In summary, the present invention provides a control device having a variable orifice positioned in a housing passageway for supplying pressurized air to a pneumatic motor. In accordance with the present invention, as the motor approaches stall, the size of the orifice is increased in response to the increased motor back pressure. Enlarging the orifice at this time results in an increase in pressure to the motor just prior to shut-off, thereby increasing the motor torque. By controlling the final increase in pressure to the motor in this manner, the desired shut-off torque in both soft make and hard make operations is achieved more accurately.

In accordance with the provisions of the patent statutes, the principal and mode of operation of the invention have been explained and illustrated in a preferred embodiment. However, it must be understood that the invention can be practiced otherwise than as specifically illustrated and described without departing from its spirit and scope as defined in the appended claims.

What is claimed is:

1. A device for shutting off a supply of motive fluid under pressure to an associated fluid driven motor, said device comprising a housing, a passageway for the motive fluid extending through said housing between a fluid inlet port connected to the fluid supply and a fluid outlet port connected to the associated fluid motor, valve means shiftable to close said passageway in response to fluid pressure at said outlet port, an orifice of variable size within said passageway, a pilot piston slidably mounted within said housing and coupled to vary the size of said orifice, said pilot piston having a passageway extending therethrough and forming a portion of the motive fluid passageway, said pilot piston being responsive to predetermined fluid pressure at said outlet port and shiftable between a first position and a second position, a restriction element cooperating with said piston passageway for defining said variable orifice, said pilot piston and said restriction element cooperating to enlarge the size of said orifice as said pilot piston is shifted between said first and said second positions and a shut-off piston slidably mounted within said housing and shiftable to close said housing passageway whereby fluid pressure at said outlet port is increased before said valve means closes said passageway.

2. A device according to claim 1 wherein the rate at which said orifice is enlarged is a function of the rate of increase of fluid pressure at said outlet port.

3. A device according to claim 1 wherein said orifice is variable between a first, predetermined size and a second, predetermined size larger than the first size.

4. A device according to claim 1 wherein said valve means includes means responsive to the predetermined fluid outlet pressure for delaying the shifting of said shut-off piston for a predetermined time after the outlet pressure reaches the predetermined point.

5. A device according to claim 4 wherein said means for delaying includes a chamber exposed to at least a portion of said shut-off piston, and means responsive to said predetermined outlet pressure for introducing pressurized fluid into said chamber at a controlled rate, said shutoff piston being responsive to a predetermined fluid pressure in said chamber for shifting to close said housing passageway.

6. A device according to claim 5 including means for adjusting the rate at which said chamber pressure reaches the predetermined pressure.

7. A device according to claim 5 wherein said means for introducing pressurized fluid into said chamber blocks the supply of fluid to said chamber when said orifice is at the first predetermined size.

8. A device according to claim 5 wherein said pilot piston is adapted to block the supply of fluid to said chamber when said pilot piston is in its first position.

9. A device for shutting off a supply of motive fluid under pressure to an associated fluid driven motor, said device comprising a housing, a passageway for the motive fluid extending through said housing between a fluid inlet port connected to the fluid supply and a fluid outlet port connected to the associated fluid motor, valve means shiftable to close said passageway in response to fluid pressure at said outlet port, an orifice of variable size within said passageway, a pilot piston slidably mounted within said housing and coupled to vary the size of said orifice, said pilot piston having a passageway extending therethrough forming a portion of the motive fluid passageway, said pilot piston being responsive to predetermined fluid pressure at said outlet port and shiftable between a first position and a second position, a restriction element cooperating with said piston passageway for defining said variable orifice, said pilot piston and said restriction element cooperating to enlarge the size of said orifice as said pilot piston is shifted between said first and second positions, a shut-off piston slidably mounted within said housing and shiftable to close said housing passageway, and means responsive to the predetermined fluid outlet pressure for delaying the shifting of said shut-off piston for a predetermined time after the outlet pressure reaches the predetermined point.

* * * * *